US006729964B2

(12) United States Patent
Reeves, Jr.

(10) Patent No.: US 6,729,964 B2
(45) Date of Patent: May 4, 2004

(54) BILLIARDS PRACTICE TABLE

(76) Inventor: Charles E. Reeves, Jr., 175 Evandale Ave., #8, Mountain View, CA (US) 94043

( * ) Notice: Subject to any disclaimer, the term of this patent is extended or adjusted under 35 U.S.C. 154(b) by 0 days.

(21) Appl. No.: 10/167,877

(22) Filed: Jun. 12, 2002

(65) Prior Publication Data

US 2003/0232658 A1 Dec. 18, 2003

(51) Int. Cl.[7] ..... A63D 15/00; A63D 15/04; A63D 15/02

(52) U.S. Cl. ..... 473/2; 473/14; 473/19; 273/123 R

(58) Field of Search ..... 473/1–4, 6, 9, 473/10, 14, 17, 19, 29, 31

(56) References Cited

U.S. PATENT DOCUMENTS

| | | | | | |
|---|---|---|---|---|---|
| 223,208 | A | * | 12/1879 | Disston | 473/19 |
| 242,584 | A | * | 6/1881 | Bensinger | 273/123 R |
| 305,913 | A | * | 9/1884 | Gately | 473/9 |
| 552,786 | A | * | 1/1896 | Smith | 473/14 |
| 560,739 | A | * | 5/1896 | Mumbrauer | 273/125 R |
| 830,180 | A | * | 9/1906 | Schultz | 273/123 R |
| 855,728 | A | * | 6/1907 | Pingrey | 273/123 R |
| 1,146,506 | A | * | 7/1915 | Ley | 273/126 R |
| 1,245,820 | A | * | 11/1917 | Teruya | 273/123 R |
| 1,468,336 | A | * | 9/1923 | Vondersloot | 273/123 R |
| 1,759,156 | A | * | 5/1930 | Fish | 473/143 |
| 1,801,142 | A | * | 4/1931 | Crosthwait | 473/19 |
| 1,856,117 | A | * | 5/1932 | Small, Jr. | 273/125 R |
| D90,752 | S | * | 9/1933 | Deming | D21/312 |
| 2,010,282 | A | * | 8/1935 | Wannemacher | 473/2 |
| 2,827,299 | A | * | 3/1958 | Dean | 473/158 |
| 3,141,673 | A | * | 7/1964 | Scott | 273/123 R |
| 3,961,793 | A | | 6/1976 | Zanders | |
| 3,989,244 | A | * | 11/1976 | Wadina | 473/2 |
| 4,056,266 | A | | 11/1977 | Gramstrup | |
| 4,120,494 | A | | 10/1978 | Roe | |
| 4,448,418 | A | | 5/1984 | McNeill | |
| 4,986,542 | A | | 1/1991 | Bonnet | |
| 5,042,813 | A | * | 8/1991 | Huang | 473/153 |
| 5,401,215 | A | * | 3/1995 | Pfost | 473/2 |
| 5,520,581 | A | * | 5/1996 | Mazzoli | 473/2 |
| 6,053,817 | A | | 4/2000 | Fiegel | |
| 6,132,319 | A | | 10/2000 | Schulter | |
| 6,299,164 | B1 | | 10/2001 | Yi | |
| 6,347,797 | B1 | | 2/2002 | Tsai | |
| 6,349,939 | B1 | | 2/2002 | Tsai | |
| 6,582,316 | B2 | * | 6/2003 | Tompert | 473/2 |

* cited by examiner

*Primary Examiner*—Gregory Vidovich
*Assistant Examiner*—Mitra Aryanpour
(74) *Attorney, Agent, or Firm*—Ray K. Shahani, Esq.

(57) ABSTRACT

A billiard practice platform, comprising a playing surface with two side rails and a back wall defining an open-ended practice area, and a target panel located essentially parallel to and adjacent the back wall thereby defining a ball capture portion, the target panel having at least one arch-defining openings therethrough, wherein a user shoots a cue ball toward a target ball with the objective of propelling the target ball through the at least one arch-defining opening and into the ball capture portion.

9 Claims, 7 Drawing Sheets

100

100

BILLIARDS PRACTICE TABLE

This application is related to Disclosure Document Number 506305 filed on Feb. 24, 2002, and claims any and all benefit of priority of filing date of said Disclosure Document as may be entitled to thereby.

FIELD OF THE INVENTION

The present invention relates to a system for training and practicing cue sports, and any and all varieties of billiards, in which balls roll on a table, and the player strikes a ball with the pointed end of a stick causing various interactions with the balls. In particular, this invention relates to the practice of cue sports in a limited space which would prohibit the use of a standard size billiard table.

BACKGROUND OF THE INVENTION

Cue sports have long been one of the most popular recreational games. The game is played on a flat surface with pockets where a player can shoot billiard balls using a stick. The history of billiards dates back from the 15th century in Europe. It has evolved into a very challenging and exciting game today.

One of the most important skills in playing this game is having a combination of solid and reliable stroke and an exceptional sense of aim. To master the game, a player must gain accuracy by practicing after having learned the fundamentals of a superior stroke. Perfecting this skill takes hours of practice after learning the mechanics of the game.

The main problem facing people interested in perfecting their skills is equipment limitations. Pool tables are very large and expensive. Most people cannot accommodate a full size pool table in their place of residence.

Therefore, there is a need for an affordable and compact device for cue sport enthusiasts who wish to practice at home. The existing prior art does not address these concerns. There are some accessories to enhance aiming skills of players but they have to be placed on a regular table and do not solve the aforementioned problems. The following is but representative of the devices of the prior art:

U.S. Pat. No. 3,989,244 issued on Nov. 2, 1976 to Wadina teaches a portable pool guide aiming and teaching device that helps a player master banking. This device enables a pool player to pre-determine the direction to drive a cue ball and to see what shots are possible before executing the actual shot. This is a device that sits on a full size table.

U.S. Pat. No. 5,401,215 issued on Mar. 28, 1995 to Pfost describes an apparatus for aiming billiard balls comprising an object ball with a surface coated with an array of colored dots. The varied colors of the dots allow a player to distinguish and remember the contact dot in order to easily aim correctly, without any guess work. This also is a device that sits on a full size table.

U.S. Pat. No. 5,520,581 issued on May 28, 1996 to Mazzoli describes a lightweight portable device that may be placed on the table and it includes a pair of arms pivotally supported on a base. This device permits a player to practice and vary different aspects of a bank shot such as the speed of the ball, the speed of the spin, and the direction of spin along the same angle of attack in order to practice the effect such variations will have on the resultant shot.

As such, it can be seen that currently available devices have many shortcomings and there is a need for a compact and affordable table that allows those interested in cue sports to practice and improve their skills.

OBJECTS AND ADVANTAGES

In view of the foregoing limitations and shortcomings of the prior art, there exist a need for a table that solves the above mentioned problems. It is therefore an object and advantage of the present invention to provide a device for learning and practicing cue sports, and, in particular billiards and pool, which obviates for practical purposes the above mentioned limitations.

It is a primary object and advantage of the present invention to provide a cue sport practice platform that parallels billiard tables but requires only a fraction of space and expense.

It is another object and advantage of the present invention to provide a device that is compact enough to be used at home and to allow one to improve skills in the game. The present invention provides for practicing all cue sport techniques and elements at home in ⅓ to ¼ of the space needed for standard tables.

It is yet another object and advantage of the present invention to provide a device that is affordable to one interested in learning and practicing cue sports. The present invention provides for practicing all cue sport techniques at a fraction of expense.

SUMMARY OF THE INVENTION

The present invention is a practice device to teach and to improve one's skill in the cue sport area.

One embodiment of this invention provides a practice platform which is open in the front, has a front removable bar or target panel and it has a storage compartment in the back. The bed is boarded on three sides and has side rails mounted onto the base with bolts that screw into Tee nuts already embedded in the base. The two side rails are covered on the inside with a synthetic rubber-like material.

The storage compartment at the end of the base is a box like structure, designed for ball storage, and made up of panels mounted onto the base with Hex bolts. The front panel of the storage compartment is a removable target panel that could have a number of holes through which the balls roll.

Other embodiments of the present invention could include removable target panels with 4 inch-holes for the novice, or 3 inch-holes for more advanced players.

Another embodiment of the present invention could include removable target panels with 2.5 inch-holes to accommodate practice at Snooker.

Another embodiment of the present invention could include removable target panels without any holes to facilitate practice of Three Cushion Billiards and Banking.

BRIEF DESCRIPTION OF THE DRAWINGS

The invention is illustrated below and represented schematically in the following drawings.

DETAILED DESCRIPTION OF THE PREFERRED EMBODIMENT

The description that follows is presented to enable one skilled in the art to make and use the present invention, and is provided in the context of a particular application and its requirements. Various modifications to the disclosed embodiments will be apparent to those skilled in the art, and the general principals discussed below may be applied to other embodiments and applications without departing from the scope and spirit of the invention. Therefore, the invention is not intended to be limited to the embodiments disclosed, but the invention is to be given the largest possible scope which is consistent with the principals and features described herein.

Figure 1A:
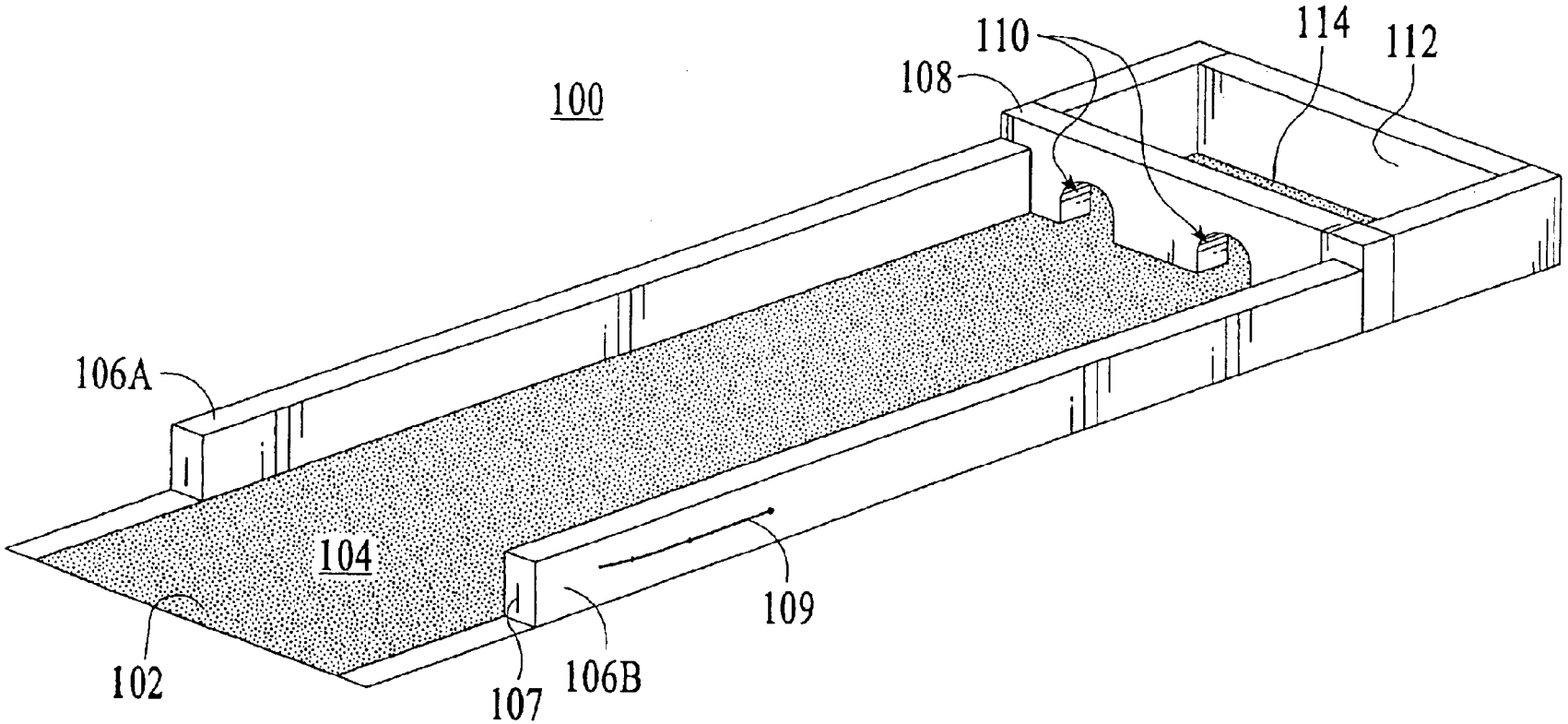
FIG. 1A is a representative schematic drawing of a preferred embodiment of the present invention.

FIG. 1A is a representative schematic drawing of a preferred embodiment of the present invention. This drawing shows the billiards practice platform 100 with a base portion 102 covered with billiard cloth 104, side rails or panels 106A–B, a back panel 112, and a target panel 108 having two arches 110.

In a preferred embodiment of the present invention, the platform 100 includes a base portion 102 that is about 66 inches long and about 2 feet wide. The playing surface or bed of the base is about 21 inches wide and about 58 inches long and about ¼ inch thick and it is covered with billiard cloth 104. The side rails 106A–B are about 48 inches long, about 3 inches wide and about 2 inches thick and they are mounted onto the base with about 5/16 Hex bolts that screw into about 5/16 Tee Nuts already embedded in the base.

A player stands at the front of the platform and shoots the balls into the arches 110 of the target panel 108. The storage compartment or ball capture area 114 is a chamber that holds the balls that roll in through either one of the arches 110.

Figure 1B:
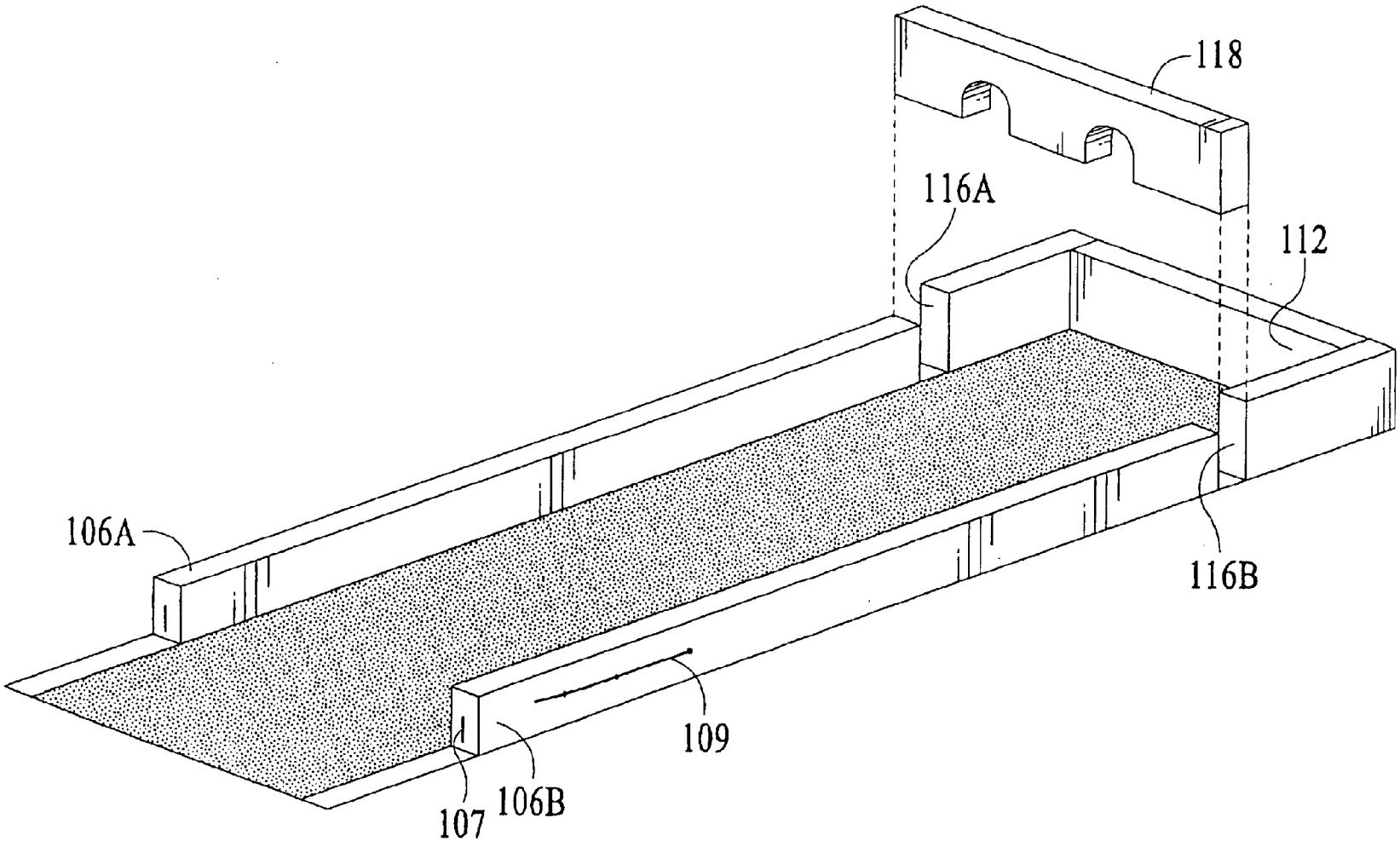
FIG. 1B shows a schematic view of a preferred embodiment of the present invention demonstrating the removable target panel.

FIG. 1B shows a schematic view of a preferred embodiment of the present invention with a removable target panel 118. This drawing shows a billiards practice platform 100 with a removable bar or target panel 118 removed from the slots 116 A–B of the side panels 106 A–B.

Figure 1C:
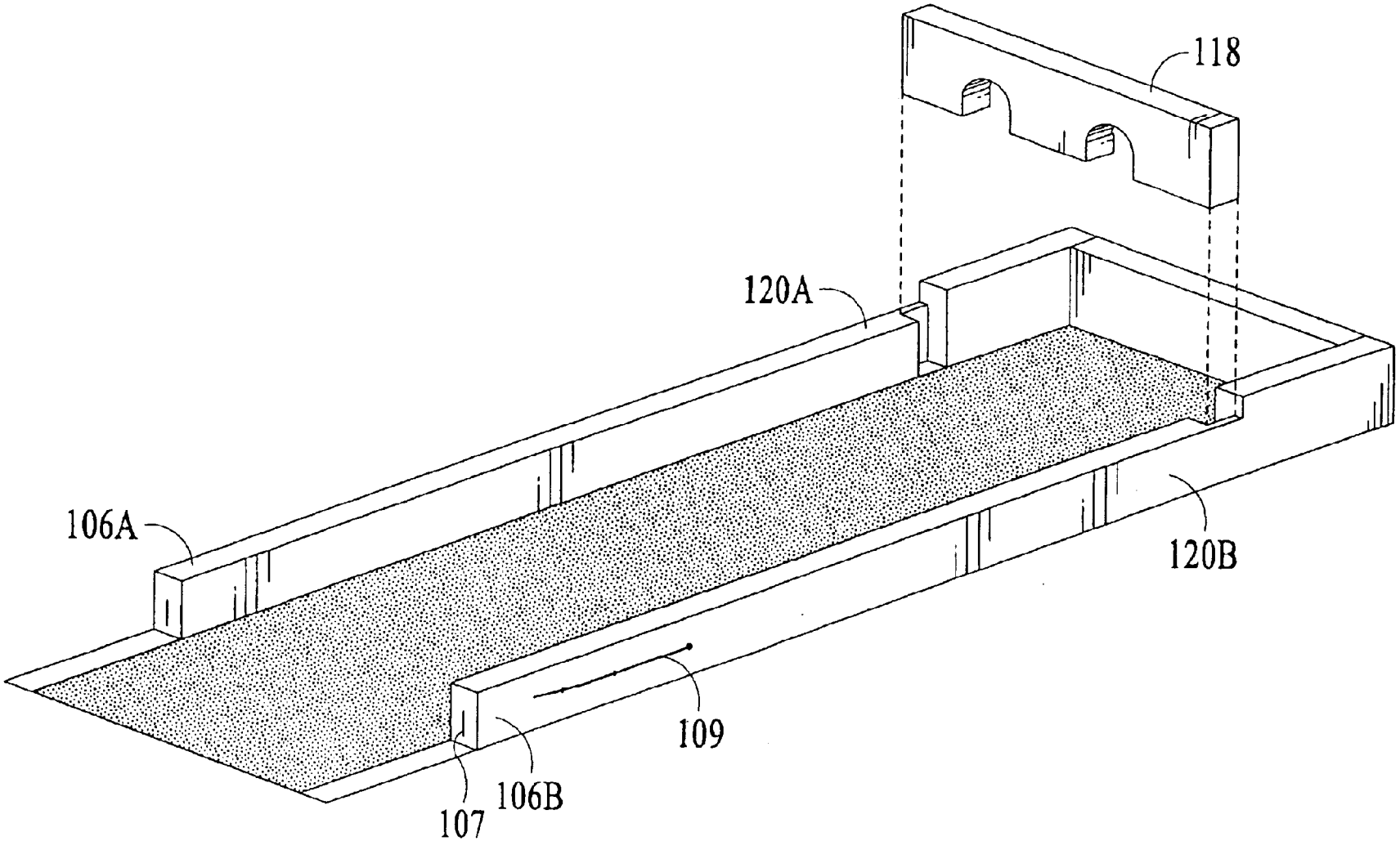
FIG. 1C shows a schematic view of another preferred embodiment of the present invention with a removable target panel.

FIG. 1C shows a schematic view of another preferred embodiment of the present invention with a removable target panel. This drawing shows another embodiment with different side panels 120 A–B. These side panles 120 A–B have a slot placed in them to to allow the removable target panel 118 to slide in and out.

Figure 2A:
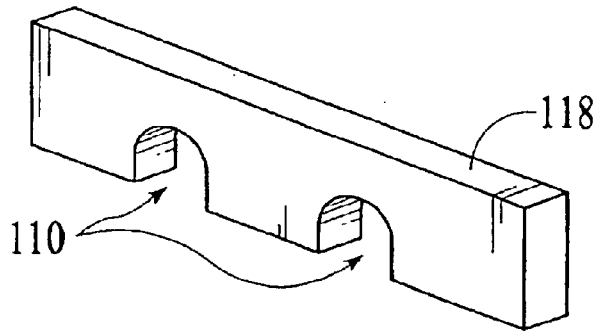
FIG. 2A is a schematic view of a preferred embodiment of the target panel with two equally sized arches.

FIG. 2A is a schematic view of a preferred embodiment of the target panel 118 with two equally sized arches 110. This drawing shows one embodiment of the removable target panel 118 having two arches 110 of equal sizes.

Figure 2B:
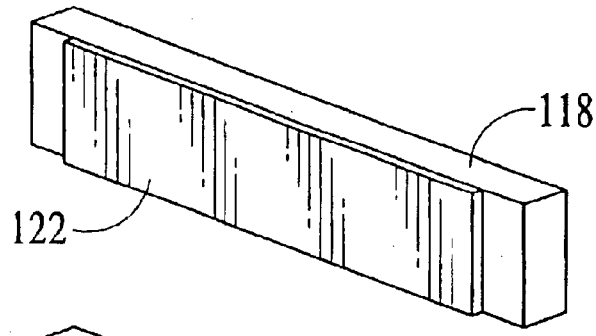
FIG. 2B is a schematic view of another embodiment of the target panel covered with a rubber film and without any arches.

FIG. 2B is a schematic view of another embodiment of the target panel 118 covered with a rubber film 122 and without any arches. This drawing shows another embodiment of the removable target panel 118 covered with a film 122 and no arches.

Figure 2C:
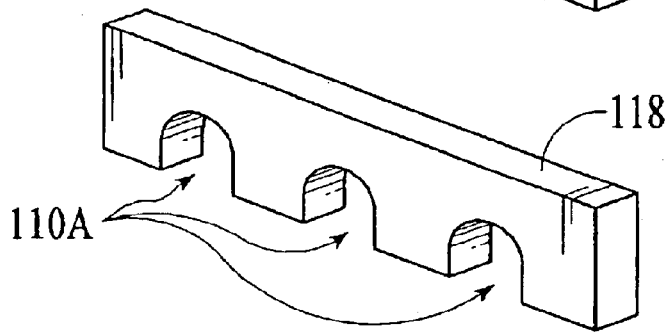
FIG. 2C is a schematic view of another embodiment of the target panel with three equally sized arches.

FIG. 2C is a schematic view of another embodiment of the target panel 118 with three equally sized arches 110A. This drawing shows another embodiment of the removable target panel 118 with three arches 110A of equal sizes. It will be understood, therefore, that there may be 2 or 3 or four same or different sized opening arches 110A in the target panel 118.

Figure 2D:
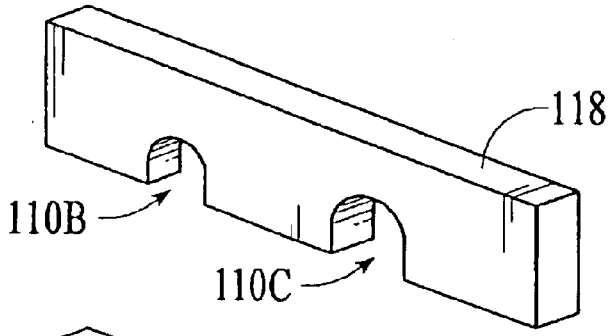
FIG. 2D is a schematic view of another embodiment of the target panel with arches of different sizes.

FIG. 2D is a schematic view of another embodiment of the target panel 118 with arches of different sizes 110B and 110C. This drawing shows another embodiment of the removable target panel 118 with one small arch 110B, and one large arch 110C.

Figure 2E:
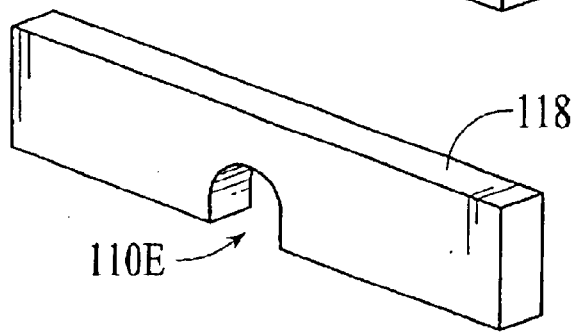
FIG. 2E is a schematic view of a preferred embodiment of the target panel with a single arch.

FIG. 2E is a schematic view of a preferred embodiment of the target panel 118 with a single arch 110E.

Figure 3:
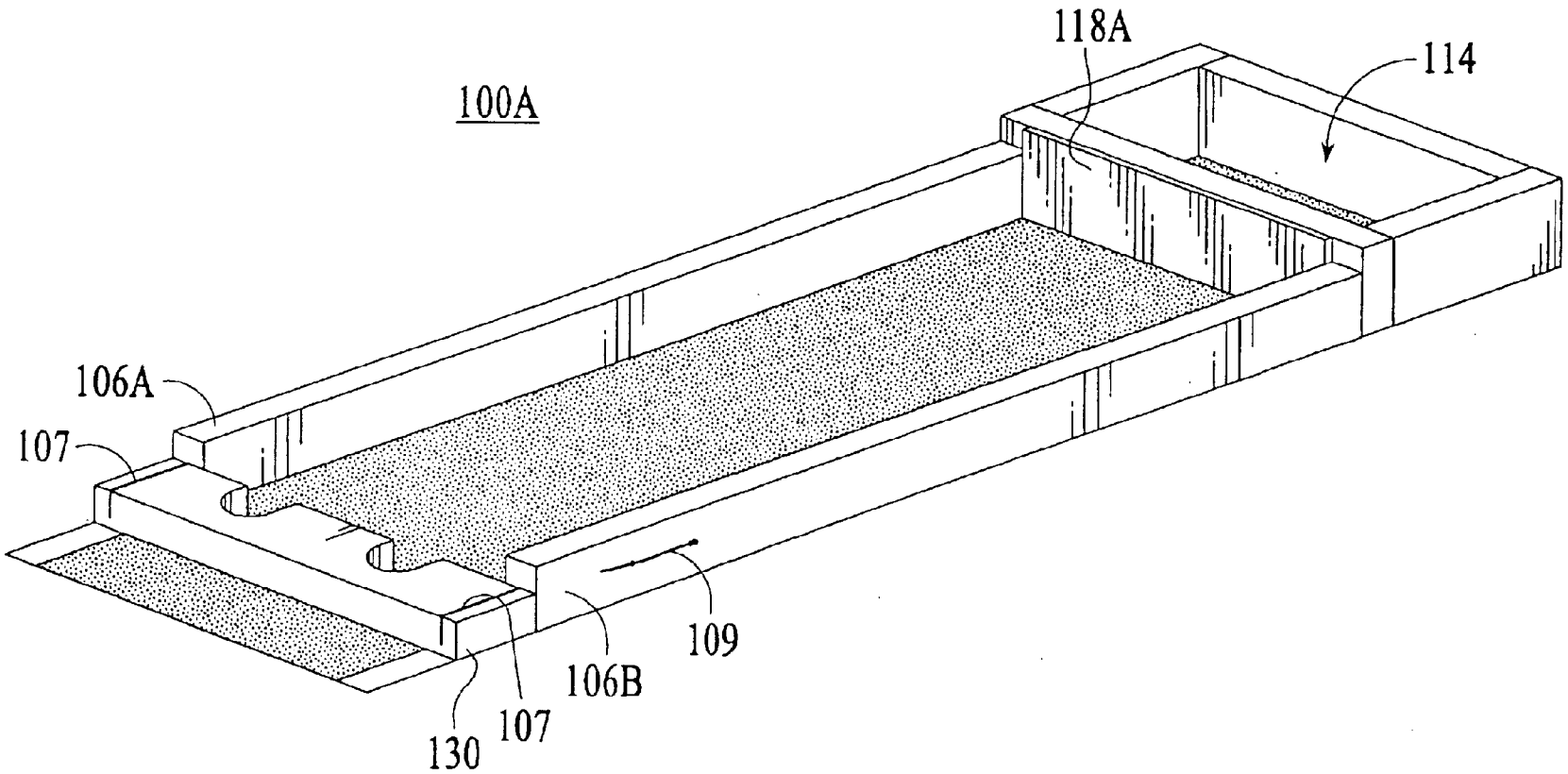
FIG. 3 is a schematic view of another embodiment of the present invention with a front panel.

FIG. 3 is a schematic view of another embodiment of the present invention 100A with a front panel 130. In this embodiment of the practice platform 100A, the front panel can be layed on its side, as shown, or can be stood up, and permanently or temporarily attached to the base platform 102 or side rails 106A–B. As shown, sliding hooks 107 operated by sliding rods 109 or similar internal operating structure grasp the ends of the removable target panel 130. Furthermore, in this embodiment, while any target panel bar 118 can be used, the target panel 118A (shown) is similar to that described in FIG. 2B. The front of the solid blank portion 118B can have a layer of felt, rubber, shock absorbent material, or other rubber 122, as shown. Also as shown above, the storage chamber 114 captures balls that roll into the chamber area 114 from the main playing area.

Figure 4A:
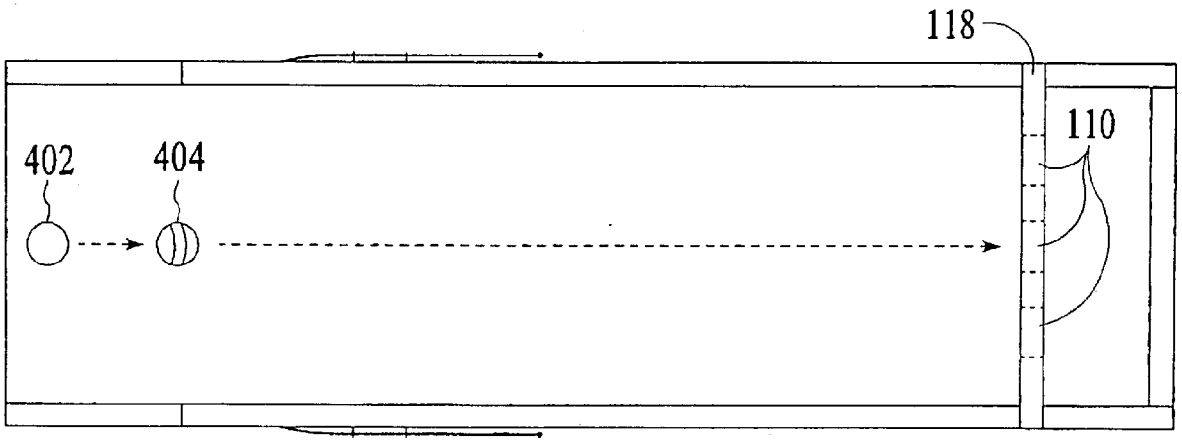
FIG. 4A is a schematic representation of one possible practice shot.

FIG. 4A is a schematic representation of a preferred method of use of the present invention. It will be understood by those skilled in the art that an important practice shot is the direct shot. as shown, cue ball 402 is shot in an essentially straightforward direction into target ball 404 which is directed or propelled in an essentially forward direction, hopefully through an arch 110 in the target panel 118. As the aim of the user improves, the size of the arch 110 can be reduced to increase the level of difficultness.

Figure 4B:
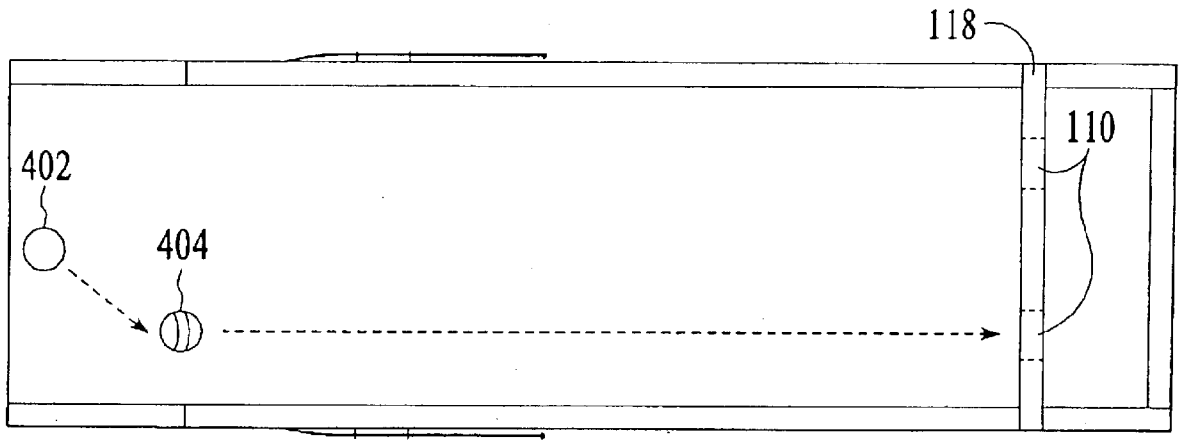
FIG. 4B is a schematic representation of another possible practice shot.

FIG. 4B is a schematic representation of another preferred method of use of the present invention. In this practice shot, the cue ball 402 is directed down the practice platform 100 at an angle, striking the target ball 404 and directing or propelling the target ball 404 in an essentially forward direction, again hopefully through an arch 110 in the target panel 118.

Figure 4C:
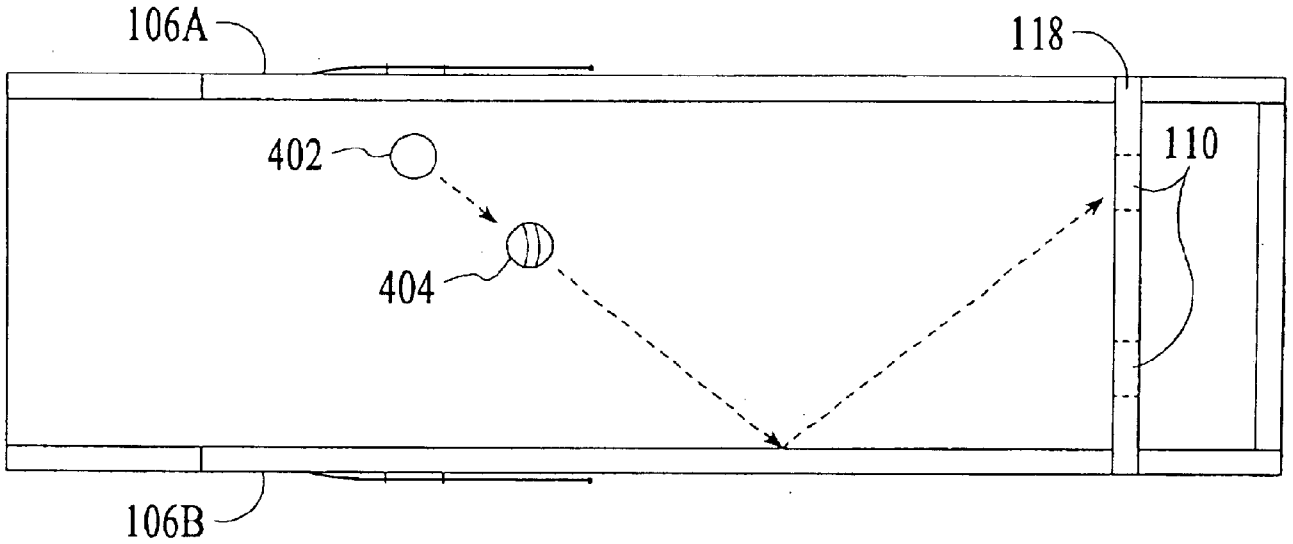
FIG. 4C is a schematic representation of a side practice shot.

FIG. 4C is a schematic representation of yet another preferred method of use of the present invention. In this practice shot, the cue ball 402 is shot toward a target ball 404 which bounces off of a side rail 106A–B, and then continues through an arch 110 in the target panel 118.

Figure 4D:
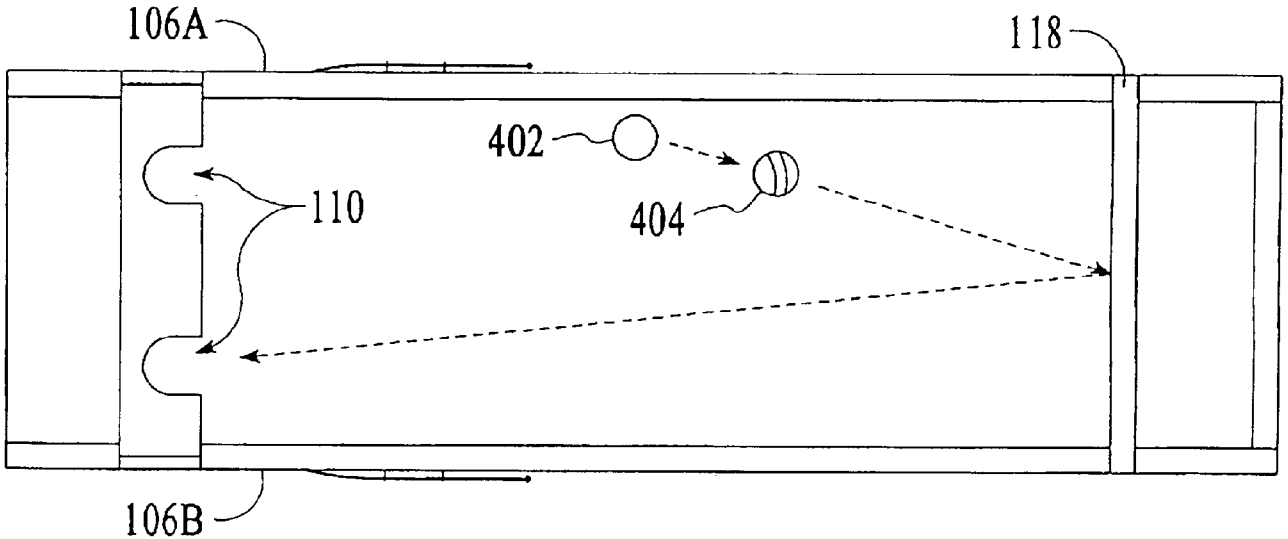
FIG. 4D is a schematic representation of another side practice shot.

FIG. 4D is a schematic representation of yet another preferred method of use of the present invention. In this practice shot, the platform 100A as best shown in FIG. 3 is utilized. The cue ball 402 is used to strike the target ball 404 and shoot it toward the solid target panel 118 (as best shown in FIG. 2B), and then the target ball continues backwards toward the target panel 130 at the front end of the platform 100A and, hopefully, comes to rest in an arch 110 located therein.

It will be understood that the shots shown in particular in FIGS. 4C and 4D may properly be considered bank shots, and other variations are possible, including striking the target ball with the cue ball such that it banks off a side wall, a side wall and a back wall, a back wall and then a side wall, or simply the back wall.

In a preferred embodiment, the playing surface 102 and side rail 106A–B are covered with billiard cloth.

Unless defined otherwise, all technical and scientific terms used herein have the same meaning as commonly understood by one of ordinary skill in the art to which this invention belongs. Although any methods and materials similar or equivalent to those described can be used in the practice or testing of the present invention, the preferred methods and materials are now described. All publications and patent documents referenced in this application are incorporated herein by reference.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true purview, spirit and scope of the invention.

I claim:

1. A billiard practice platform, comprising:

a playing surface with two side rails and a back wall defining an open-ended practice area, the two side rails parallel to each other and perpendicular to the back wall;

a target panel located essentially parallel to and adjacent the back wall, the target panel positioned in front of the back wall, the target panel spaced apart from the back wall and not in direct contact with the back wall, thereby defining a ball capture portion located between the target panel and the back wall, the target panel having at least one arch-defining openings therethrough, wherein a user shoots a cue ball toward a target ball with the objective of propelling the target ball through the at least one arch-defining opening and into the ball capture portion; and sliding rods located internally within the side rails, the sliding rods having hooks capable of grasping a secondary target panel at the open end.

2. The billiard practice platform of claim 1, further comprising slots located in the side rails, such that the target panel is removable during play.

3. The billiard practice platform of claim 1, further comprising a plurality of interchangeable target panels, the plurality of target panels each comprising one or more arch-defining openings therethrough.

4. The billiard practice platform of claim 1 in which the target panel has at least two different sized arch defining openings therethrough.

5. The billiard practice platform of claim 1 in which the playing surface is covered with billiard cloth.

6. The billiard practice platform of claim 1 in which the side rails are covered with billiard cloth.

7. The billiard practice platform of claim 1 in which the target panel is covered with a rubber film.

8. The billiard practice platform of claim 1 in which the side rails are covered with synthetic rubber like material.

9. The billiard practice platform of claim 1 comprising a secondary target panel for engagement with said hooks at said open end.

* * * * *